United States Patent [19]

Itoh et al.

[11] Patent Number: 4,673,598

[45] Date of Patent: Jun. 16, 1987

[54] TWO STAGE FLAMEPROOFING OF CELLULOSIC FABRIC

[75] Inventors: Shimpei Itoh, Toyonaka; Tadao Sasakura, Itami, both of Japan

[73] Assignee: Nitto Boseki Co., Ltd., Fukushima, Japan

[21] Appl. No.: 863,173

[22] Filed: May 14, 1986

[30] Foreign Application Priority Data

May 15, 1985 [JP] Japan ..... 60-103387

[51] Int. Cl.[4] ..... B05D 3/02

[52] U.S. Cl. ..... 427/412; 427/393.3; 427/396

[58] Field of Search ..... 8/196, 190, 189, 127.1; 427/393.3, 412, 396, 394; 252/608

[56] References Cited

U.S. PATENT DOCUMENTS 2,782,133 2/1957 Vallette ..... 428/289
3,276,906 10/1966 Nielsen ..... 427/412 X
4,046,701 9/1977 Smith ..... 252/608
4,174,418 11/1979 Welch et al. ..... 427/396 X
4,347,285 8/1982 Batdorf ..... 427/393.3 X

FOREIGN PATENT DOCUMENTS 0144025 11/1948 Australia ..... 427/412
57-117671 7/1982 Japan ..... 427/393.3

*Primary Examiner*—Thurman K. Page
*Attorney, Agent, or Firm*—Bert J. Lewen; Henry Sternberg

[57] ABSTRACT

The present invention relates to a flameproofing process which comprises treating a woven or knitted fabric comprising a cellulosic fiber with a boron hydride compound and/or a metal borohydride compound, followed by treating it with an amidophosphazene compound. According to the invention, a flameproofed product excellent in whiteness degree is obtained and, when the starting fabric is a lightly dyed fabric, a flameproofed product excellent in color tone is obtained.

7 Claims, No Drawings

TWO STAGE FLAMEPROOFING OF CELLULOSIC FABRIC

The present invention relates to a flameproofing process which comprises treating a woven or knitted fabric comprising a cellulosic fiber with a boron hydride compound and/or a metal borohydride compound and then treating it with an amidophosphazene compound.

PRIOR ART

A flameproofing process which comprises treating a woven cotton fabric with an aqueous solution of an amidophosphazene compound, squeezing it, drying it and then baking it is disclosed in U.S. Pat. No. 2,782,133.

However, the process is disadvantageous in that the cotton fabric flameproofed by it is colored yellow or brown. Although the mechanism of this coloration is unknown, viscose rayon more markedly undergoes this coloration than cotton.

BRIEF SUMMARY OF THE INVENTION

This coloration can be prevented by treating a fabric comprising cellulosic fiber with a boron hydride compound and/or a metal borohydride compound and then treating it with an amidophosphazene compound.

The present invention relates to a flameproofing process wherein a woven or knitted fabric comprising cellulosic fiber is prevented from the coloration, taking place in the process of its flameproofing treatment, by the use of an amidophosphazene compound.

If a woven or knitted fabric comprising cellulosic fiber is scoured, bleached, dipped in an aqueous solution of amindophosphazene compound, squeezed, dried and then baked, the bleached woven or knitted fabric turns to a yellow or brown color and its whiteness degree decreases, as has been mentioned above. In case of a fabric which has been scoured and then dyed so as to have a light color, its color changes upon the flameproofing treatment. The present inventors have conducted many studies on the method for preventing such colorations to accomplish the present invention.

DETAILED DESCRIPTION OF THE INVENTION

The process of the invention is characterized by treating a woven or knitted fabric comprising cellulosic fiber with a boron hydride compound and/or a metal borohydride compound and then treating it with an amidophosphazene compound. As said cellulosic fiber, there can be included cotton, flax, viscose rayon and polynosics. The woven or knitted fabrics comprising cellulosic fiber include those composed of only one of the above-mentioned cellulosic fibers, those composed of a combination of different cellulosic fibers and those composed of a combination of cellulosic fiber and synthetic fiber. As examples of said woven or knitted fabric comprising cellulosic fiber, there can be included a woven fabric composed of 100% cotton, a woven fabric composed of 60% cotton and 40% polyester, a woven fabric composed of 35% viscose rayon and 65% polyester, a woven fabric composed of 100% polynosics, and the like. As said boron hydride compound and metal borohydride compound, there can be included sodium borohydride ($NaBH_4$), potassium borohydride ($KBH_4$), lithium borohydride ($LiBH_4$), aluminum borohydride ($Al(BH_4)_3$), and the like.

The treatment using the boron hydride compound and/or metal borohydride compound can be achieved by padding a woven or knitted fabric comprising cellulosic fiber with an aqueous solution of a boron hydride compound and/or a borohydride compound preferably having a concentration of 1 to 10 g/liter, followed by reducing cellulose with the boron hydride compound and/or the metal borohydride compound by the method of batch-up ageing at ordinary temperature, ageing using L-box, ageing using steamer, or the like. It is usually preferable that the woven or knitted fabric has been scoured or scoured and bleached before the treatment using the boron hydride compound and/or the metal borohydride compound. It is allowable to add a fluorescent whitening agent into the aqueous solution of the boron hydride compound and/or the metal borohydride compound. The coloration-preventive effect brought about by the treatment using the boron hydride compound and/or the metal borohydride compound is dependent on the concentration of treating solution, the temperature of ageing, the duration of ageing, etc. Therre is a tendency that the effect becomes more marked as the concentration of treating solution becomes higher, the temperature of ageing becomes higher, and the duration of ageing becomes longer.

As said amidophosphazene compound, there can be included those represented by the following general formula:

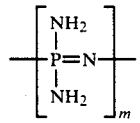

wherein m is not smaller than 3. Preferably, the treatment using the amidophosphazene compound is carried out by padding a woven or knitted fabric comprising cellulosic fiber having been treated with a boron hydride compound and/or a metal borohydride with a solution containing 5–20% by weight of an amidophosphazene compound, and a catalyst such as ammonium chloride, zinc nitrate and magnesium chloride, followed by squeezing it by means of mangle, drying it and then baking it preferably at a temperature of 150°–170° C. for 10 minutes. In another possible embodiment, a woven or knitted fabric comprising cellulosic fiber having been treated with a boron hydride compound and/or a metal borohydride is once dyed and then it is treated with an amidophosphazene compound.

According to the present invention, a flame-proofed product excellent in whiteness degree is obtained. When the starting fabric is a lightly dyed fabric, a flameproofed product excellent in color tone is obtained according to the present invention.

EXAMPLE 1

A woven fabric composed of 100% cotton which had previously been scoured and bleached in the usual manner was dipped into a 1 g/liter aqueous solution of sodium borohydride at a temperature of 30° C. and squeezed so as to give a pick-up of 80%, after which it was aged at 30° C. for 15 hours to reduce the 100% cotton fabric. The reduced fabric was washed with water, dried, dipped into an aqueous solution containing 10% by weight of the following amidophosphazene compound:

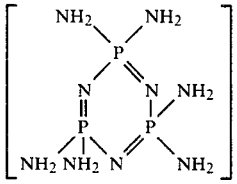

and 13% by weight of ammonium chloride at 30° C., and squeezed so as to give a pick-up of 80%. Then, it was dried at about 105° C. for 5 minutes and subsequently it was baked at 160° C. for 4 minutes. The fabric thus obtained has a Hunter whiteness degree of 90%. It exhibited a sufficient flameproofing effect.

COMPARATIVE EXAMPLE 1

The treatment of Example 1 was repeated, except that the treatment using sodium borohydride solution was not carried out. The fabric thus obtained had a Hunter whiteness degree of 85%.

EXAMPLE 2

A woven fabric compound of 70% cotton and 30% polyester which had previously been scoured in the usual manner was dipped into a 10 g/liter aqueous solution of sodium borohydride at a temperature of 30° C. and squeezed so as to give a pick-up of 100%, after which it was streamed at 120° C. for 90 seconds to make progress the reduction by sodium borohydride. The reduced fabric was washed with water and dried, and then it was dipped into a 2 g/liter solution of fluorescent whitening agent, squeezed and dried. The fabric thus obtained was dipped into an aqueous solution containing 20% by weight of the following amidophosphazene compound:

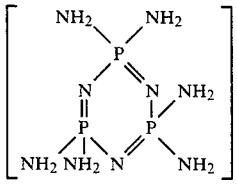

and 8% by weight of ammonium chloride at a temperature of 30° C., and then squeezed so as to give a pick-up of 100%. Subsequently, it was dried at about 120° C. for 3 minutes and baked at 165° C. for 3 minutes. The fabric thus obtained had a Hunter whiteness degree of 94%. It exhibited a sufficient flameproofing effect.

COMPARATIVE EXAMPLE 2

The treatment of Example 2 was repeated, except that the treatment using sodium borohydride was not carried out. The fabric thus obtained had a Hunter whiteness degree of 89%.

What is claimed is:

1. A flameproofing process which comprises treating a woven or knitted fabric comprising a cellulosic fiber with a boron hydride compound and/or a metal borohydride compound, followed by treating it with an amidophosphazene compound.

2. A flameproofing process of claim 1 wherein an amidophosphazene compound is a compound of the formula:

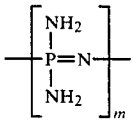

wherein m is not smaller than 3.

3. A flameproofing process of claim 1 wherein an amidophosphazene compound is a compound of the formula:

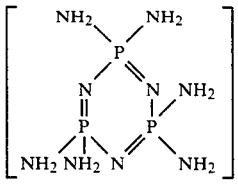

4. A flameproofing process of claim 1 wherein a metal borohydride compound is sodium borohydride.

5. A flameproofing process of claim 1 wherein a metal borohydride compound is potassium borohydride.

6. A flameproofing process of claim 1 wherein a metal borohydride compound is lithium borohydride.

7. A flameproofing process of claim 1 wherein a metal borohydride compound is aluminum borohydride.

* * * * *